US008766071B2

(12) United States Patent
Risolia

(10) Patent No.: US 8,766,071 B2
(45) Date of Patent: Jul. 1, 2014

(54) INSTRUMENT PICK AND METHOD OF MANUFACTURE

(75) Inventor: Joseph Robert Risolia, Miami, FL (US)

(73) Assignee: Magneta Enterprises, LLC, Miami, FL (US)

( * ) Notice: Subject to any disclaimer, the term of this patent is extended or adjusted under 35 U.S.C. 154(b) by 0 days.

(21) Appl. No.: 13/488,281

(22) Filed: Jun. 4, 2012

(65) Prior Publication Data

US 2013/0319203 A1 Dec. 5, 2013

(51) Int. Cl.
*G10D 3/16* (2006.01)

(52) U.S. Cl.
USPC ..... 84/322

(58) Field of Classification Search
USPC ..... 84/322
See application file for complete search history.

(56) References Cited

U.S. PATENT DOCUMENTS

| | | | | | |
|---|---|---|---|---|---|
| 4,080,520 | A | | 4/1889 | Stoll | |
| 3,650,172 | A | * | 3/1972 | Osborne | 84/322 |
| 3,992,975 | A | | 11/1976 | Gallagher | |
| 4,015,502 | A | * | 4/1977 | Strong | 84/322 |
| 4,064,781 | A | * | 12/1977 | Fals | 84/322 |
| 4,141,943 | A | | 2/1979 | Houska | |
| 4,543,382 | A | | 9/1985 | Tsuchida et al. | |
| 4,711,150 | A | * | 12/1987 | Hyduck | 84/322 |
| 5,610,349 | A | * | 3/1997 | Fogarty et al. | 84/322 |
| 5,894,097 | A | * | 4/1999 | Barry | 84/322 |
| 5,973,243 | A | | 10/1999 | Christenson | |
| 6,171,107 | B1 | | 1/2001 | Milne | |
| 6,335,477 | B1 | | 1/2002 | Miller | |
| D489,396 | S | | 5/2004 | Oskorep | |
| 6,791,017 | B2 | | 9/2004 | Oskorep | |
| 6,846,977 | B2 | * | 1/2005 | Oskorep | 84/322 |
| 6,933,430 | B2 | | 8/2005 | Oskorep | |
| 7,186,908 | B2 | | 3/2007 | Hodesh et al. | |
| 7,265,285 | B2 | * | 9/2007 | Storey | 84/322 |
| 7,956,264 | B2 | * | 6/2011 | Risolia | 84/322 |
| 2004/0074370 | A1 | | 4/2004 | Oskorep | |
| 2004/0237753 | A1 | * | 12/2004 | Savage | 84/322 |
| 2005/0092159 | A1 | | 5/2005 | Oskorep | |
| 2005/0217456 | A1 | * | 10/2005 | Hodesh et al. | 84/322 |
| 2007/0079685 | A1 | * | 4/2007 | Mizek | 84/322 |
| 2008/0163737 | A1 | | 7/2008 | Grant | |
| 2011/0179938 | A1 | * | 7/2011 | Smith | 84/322 |
| 2013/0081530 | A1 | * | 4/2013 | Risolia et al. | 84/322 |

* cited by examiner

*Primary Examiner* — Robert W Horn
(74) *Attorney, Agent, or Firm* — JPWebb; Jason P. Webb; Danny Y. H. Cheng

(57) ABSTRACT

There is an instrument pick, and its method of manufacture, having a body member including a pliable member disposed therein. The body member includes crushed magnetic elements disposed throughout the body member. The instrument pick includes a tip member disposed about an end of the body member. The tip member includes a hardened region. The instrument pick includes a plurality of selectably removable tip members having diverse acoustical properties.

20 Claims, 4 Drawing Sheets

INSTRUMENT PICK AND METHOD OF MANUFACTURE

BACKGROUND OF THE INVENTION

1. Field of the Invention

The present invention relates to instrument picks, specifically to a magnetic instrument pick and its method of manufacture.

2. Description of the Related Art

An instrument pick may be a plectrum used for guitars, or a guitar pick. A pick is generally made of one uniform material; examples include plastic, nylon, rubber, felt, tortoiseshell, wood, metal, glass, and stone. They are often shaped in an acute isosceles triangle with the two equal corners rounded and the third corner rounded to a lesser extent. Pick shapes started with guitarists shaping bone, shell, wood, cuttlebone, metal, amber, stone or ivory to get the desired shape.

Playing guitar with a pick produces a bright sound compared to plucking with the fingertip. Picks also offer a greater contrast in tone across different plucking locations; for example, the difference in brightness between plucking close to the bridge and close to the neck is much greater when using a pick compared to a fingertip. Conversely, the many playing techniques that involve the fingers, such as those found in fingerstyle guitar, slapping, classical guitar, and flamenco guitar, can also yield an extremely broad variety of tones. Guitar picks vary in thickness to accommodate different playing styles and kinds of strings. Thinner plectra are more flexible and tend to offer a wider range of sounds, from soft to loud, and produce a "click" that emphasizes the attack of the picking. However, some argue that heavier picks produce a brighter tone. Some improvements have been made in the field. Examples of references related to the present invention are described below in their own words, and the supporting teachings of each reference are incorporated by reference herein:

U.S. Pat. No. 7,186,908, issued to Hodesh et al., discloses a conventional guitar pick is retrofitted with a special adhesion material covering a selected surface region of the pick so as to enhance gripping between thumb and finger for playing and to provide convenient temporary storage, when not in use for playing, by temporary attachment onto a nearby object such as the body of the guitar. The adhesion material, specially structured to utilize suction to grip onto any smooth surface without leaving marks or residue when removed, is adhesively attached to the pick in the form of a tape or film to provide a suction gripping surface formed by special structure ranging, from multiple articulated suction cups integrally molded from rubber-like material in a uniform grid pattern, to foam-like material with a random pattern of suction pores of size ranging down to microscopic.

U.S. Pat. No. 6,933,430, issued to Oskorep, discloses a guitar pick holder is made of a thin, flat, and visually appealing flexible magnet which adheres to a front outside surface of a guitar. A guitar pick which is used with the holder is made of a synthetic material but also includes a magnetically receptive material (e.g. iron) formed on or within the synthetic material. The guitar pick is magnetically held against a front magnetic surface of the flexible magnet and is thereby carried with the guitar, even when it is subject to relatively strong forces of accelerative motion (i.e. when the guitar is physically handled or shaken).

U.S. Pat. No. 6,335,477, issued to Miller, discloses securable instrument picks for uses as thumbpicks (10) and/or fingerpicks (10) providing a string-actuating tip (20) to the side of a distal phalange (14) for a conjoined engagement of the string-actuating tip and the distal phalange against a string (42). The actuating tips may be off-set cantilevered in the character of their securement to the distal phalange, whereby a pressure resulting from an up- or downstroke upon the string is carried through the pick and delivered against the upper or lower pads, respectively, of the distal phalange. The provided picks facilitate a novel method of use in which the fingertip-flesh of the distal phalange and the string-actuating tip may be conjoined together in a stroke against the string. The provided picks also facilitate a method of producing flatpicking-type musical effects by up- and downstrokes of a single finger, tilted sideward toward the strings.

U.S. Pat. No. 6,791,017, issued to Oskorep, discloses methods of making guitar pick holders from flexible magnetic materials are described. In one illustrative example, a magnetic side of a flexible magnetic sheet is laminated with a vinyl sheet which provides a coloring and/or design. The side opposite this magnetic side is laminated with a static cling vinyl sheet, after text is reverse-printed on its non-static cling side. Coloring, design, and/or text may also be printed on the vinyl sheet. The laminated flexible magnetic sheet is then die cut to simultaneously form a plurality of guitar pick holders of a predetermined shape. Other methods are described, including methods of individually making custom guitar pick holders.

U.S. Pat. No. 4,543,382, issued to Tsuchida et al., discloses a very simple but effective means for preventing surface oxidation of fine metal powders by coating the metal powder with an organic dye. This method of surface-oxidation prevention is particularly useful for the preparation of a so-called plastic magnet which is prepared by uniformly blending a dye-coated fine powder of a magnetic alloy such as a rare earth-cobalt based permanent magnet with a thermoplastic resin such as a nylon or polyphenylene sulfide resin followed by molding the resin-powder blend into a magnet form. In addition to the remarkably improved magnetic properties of the thus prepared plastic magnets as a result of high loading and absence of degradation by oxidation, the danger of spontaneous ignition of the magnet powder in molding can be eliminated almost completely. Surface treatment of the dye-coated magnet powder with a silicone fluid gives further improved results.

The inventions heretofore known suffer from a number of disadvantages which include being limited in use, being limited in adaptability, being limited in flexibility, being expensive, being difficult to use, lacking healing properties, being devoid of health benefits, being uncomfortable, not being adaptable or customizable, failing to adhere to desired surfaces, being difficult to grip, not being able to wrap about guitar strings, being unable to be instantly customized to a plurality of users, and failing to connect items together.

What is needed is an instrument pick and its method of manufacture that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available instrument picks and their method of manufacture. Accordingly, the present invention has been developed to provide an effective magnetic instrument pick.

According to one embodiment of the invention, there is an instrument pick that may include a body member. The body member may include a pliable member that may be disposed therein. The pliable member may be a thin wire mesh. The pliable member may form a grid within the body member. The grid may include a plurality of pliable horizontal members coupled to a plurality of pliable vertical members configured to form a square grid configuration. The grid may include a single pliable member wound spirally.

The body member may include a plurality of wing members that may be extending outwardly from the body member and may be configured to wrap about a finger of a user. The body member may include crushed magnetic elements that may be disposed throughout the body member. The crushed magnetic elements may be smaller than about 1 mm in diameter. The crushed magnetic elements may be aligned to induce a magnetic field orthogonal to the plane of the body member. The crushed magnetic elements may be aligned to induce a magnetic field substantially parallel to the plane of the body member.

The instrument pick may include a tip member that may be disposed about an end of the body member. The tip member may include a hardened region. The tip may include a hardened flat conical shell that may be disposed about an end of the body member. The instrument pick may include a plurality of selectably removable tip members that may have diverse acoustical properties. The tip member may be selectably removable. The tip member may be configured to not include magnetic elements.

According to one embodiment of the invention, there is a method of manufacturing an instrument pick. The method may include the step of crushing magnets and liquefying a matrix material. The crushed magnets may be applied to the liquefied matrix material in a layer. The step of liquefying the matrix material may include melting a polymer. The method may include applying the crushed magnets to the liquefied matrix material.

The method may include the step of applying a pliable member to the liquefied matrix material. The step of applying a pliable member may include submerging a pliable member within the liquefied matrix material. The method may include applying the liquefied matrix material to an instrument pick mold, thereby forming a pliable magnetized instrument pick. The method may also include the step of providing a hardened tip to an end of the pliable magnetized instrument pick. The step of providing a hardened tip may include chemically treating an end of the pliable magnetized instrument pick. The step of providing a hardened tip may include thermally treating an end of the pliable magnetized instrument pick. The step of providing a hardened tip may include asymmetrically processing the pliable magnetized instrument pick. The step of providing a hardened tip may include attaching a hardened tip over an end of the pliable magnetized instrument pick.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
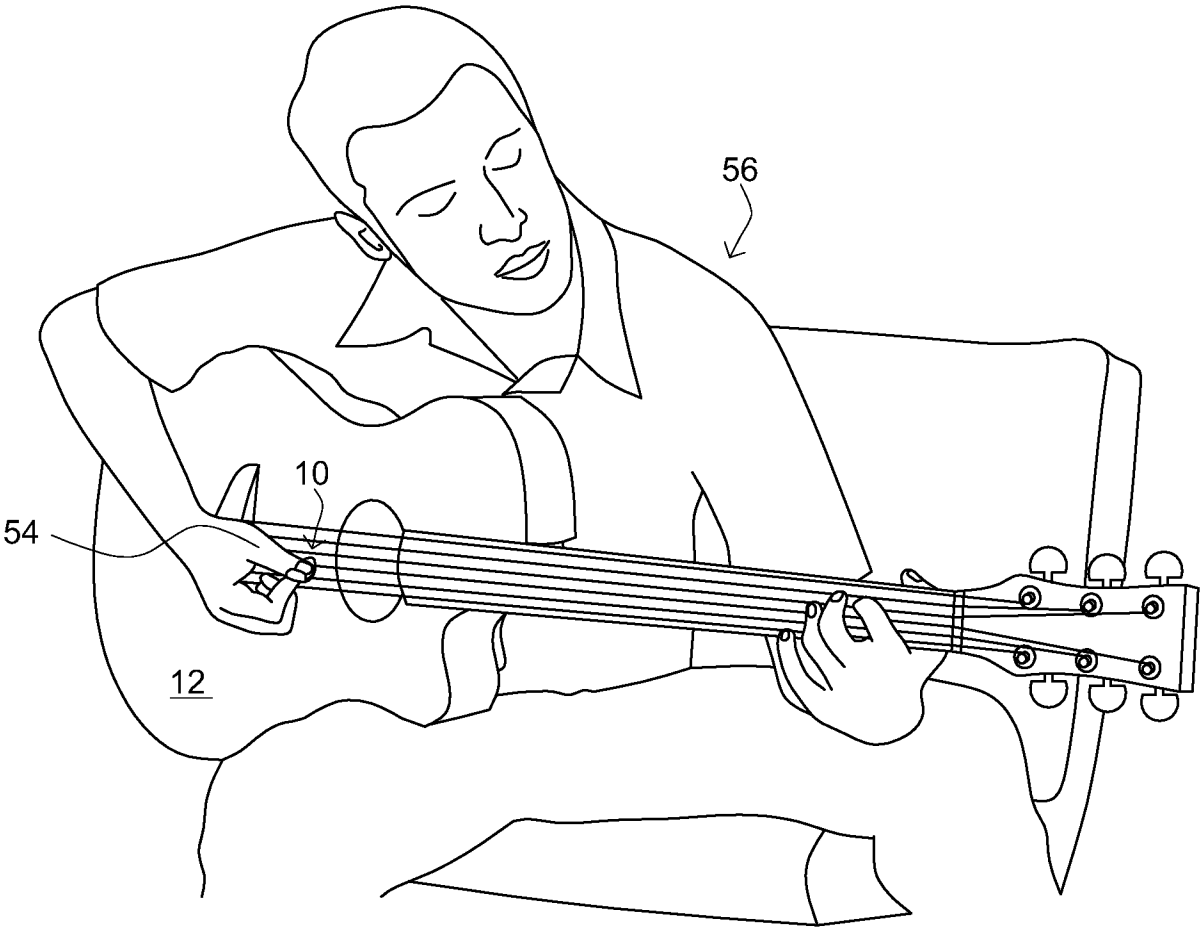
FIG. 1 is a perspective view of an instrument pick in use, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of an instrument pick in use, according to one embodiment of the invention. There is shown an instrument pick 10 molded about a thumb 54 of a user 56, being used to pick a guitar 12. The illustrated user is utilizing the illustrated instrument pick to play the guitar. Simultaneously, the instrument pick is believed to provide health benefits to the user (through application of a magnetic field) as well as making playing the guitar easier and more natural as the pick is customized to the thumb shape of the user.

The illustrated instrument pick 10 is configured to assist a user 56 in playing a musical instrument, such as a guitar 12. The instrument pick 10 is configured to pick or strike a string or strings of the musical instrument, thereby producing a sound. The illustrated instrument pick 10 is wrapped around a thumb 54 of a user 56. The instrument pick 10 may be wrapped around any other finger depending on the preference and playing style of the user 56.

In operation of one embodiment of the invention, the user grips the magnetic instrument pick and strums the strings of an instrument, such as guitar strings of a guitar. The user disposes the base member of the instrument pick about a guitar string, bridge, or neck of a guitar and the magnetic elements selectably couples to the metal of the guitar strings, bridge, or neck of the guitar, thereby securing the magnetic instrument pick to the instrument. The user may also couple multiple picks together and/or may couple such picks to other surfaces, including but not limited to drums, mic stands, and other stage gear as well as home or office appliances that may be coupled to a magnet, such as but not limited to a refrigerator. Accordingly, the picks may be easily stored in a great variety of locations. Further, because the picks include magnetic and deformable elastic materials, the picks are highly adaptable and provide substantial health and utilization benefits to users.

In one embodiment of the invention there is an instrument pick having magnetic properties. There may be a permanent magnet coupled to and/or integrated within the instrument pick. The magnetic elements may be oriented with field lines extending outward from the plane of the instrument pick. The magnetic elements may generate a magnetic field through the fingers and/or hand of a user when in use. It is theorized, without limitation to any particular theory of operation, that the magnetic field lines operate on the systems of the body to enhance health of a user, such as but not limited to enhancing blood flow, enhancing the operation of material exchange at the blood cell level, facilitating the migration of resources to cells, and/or enhancing cell membrane operation. There may be more than one magnet or magnetic elements coupled and/or disposed on or in the instrument pick. The instrument pick may be constructed of a flexible ferromagnetic material. The shape and/or size of the magnetic elements may be selected to alter a flexibility characteristic of the instrument pick and thereby alter play characteristics when in use.

There may be a method of therapy including one or more of the steps of providing a magnetic instrument pick and playing an instrument using the provided magnetic instrument pick. There may be a step of measuring a health indicator, such as but not limited to blood flow, nutrient transfer, oxygen level, and the like of an area of the body associated with operation of the magnetic instrument pick, such as but not limited to a hand or fingers/thumb. There may be a step of providing a second magnetic instrument pick having a different characteristic, such as but not limited to magnet strength, magnet size, pick flexibility, and the like, wherein the characteristic is chosen based on a measured health indicator.

In one non-limiting example, there is a magnetic field inducing material or system disposed within a pick. Such may include but is not limited to small formed magnets (cubes, cylinders, etc.) that may be sized similar to grains of sand or dust, magnetized paste, magnetic plastics, and/or looped electric currents that form magnetic fields, and the like and combinations thereof.

In one non-limiting example, there is a material included within a pick that forms a matrix wherein other materials may be deposited, including but not limited to plastics, resins, rubbers, pliable metals (gold, lead, etc.) and the like and combinations thereof.

In one non-limiting example, there is a structure deposited within a matrix wherein the structure is elastically deformable (pliable/bendable) such that is may be deformed under application of force and that such deformation remains after the applied force is removed. Such provides a grid-like structure that permits a user to elastically deform the pick, thereby customizing its form and shape as desired. Such a structure may include but is not limited to an elastically deformable material in the shape of a grid, spiral, flat plate, and the like and combinations thereof. Such a structure may be rigid under forces present during playing a guitar but elastically deformable at higher force levels (double, triple, quadruple expected force levels during use, etc.) thereby restricting deformation during use but permitting intentional deformation prior to and/or after use.

In one non-limiting embodiment, there is a tip portion of a pick that has enhanced hardness as compared to other tip portions and/or central portions of the pick. In particular, such a tip would not be considered to be elastically deformable, or would not be elastically deformable to the same degree as another portion of the pick. In particular, such would not elastically deform during normal use in playing a guitar. Accordingly, such a tip would provide a consistent response to engagement with guitar strings. Such a structure may include but is not limited to a hard tip coupled to a pick, a method of processing a tip portion that hardens the same, a plurality of differently shaped and/or sized hardened tips that are selectably removable/coupleable to the pick, a plurality of selectably removable tips having different hardness characteristics, a plurality of selectably removable tips having different acoustical properties when engaged to guitar strings, a replaceable tip, a magnetic tip, a tip that magnetically adheres to the rest of the pick body, and the like and combinations thereof.

In one non-limiting example, there is a process of combining magnetic material together with a fluid matrix material before substantial solidification of the matrix material. Such may occur in manners including but not limited to mixing fluid and/or granular materials, depositing materials in layers, generating the materials together, creating a slurry of materials, and the like and combinations thereof.

In one non-limiting example, there is a process of applying an elastically deformable structure to a matrix material before substantial solidification of the matrix material. Such may occur in manners including but not limited to applying a wire mesh to a melted matrix material, depositing a stream of melted elastically deformable material in a pattern into matrix material, mixing a slurry of elastically deformable material into a slurry of matrix material and treating (heating, crosslinking, etc.) the same to form bonds between adjacent portions of elastically deformable material, treating (heating, crosslinking, exposing to radiation, etc.) a matrix material in a manner that converts regions of the same to have properties of being elastically deformable and the like and combinations thereof.

In one non-limiting example, there is a process of providing a rigid tip to a pick. Such a process may include but is not limited to treating (heating, crosslinking, exposing to radiation, chemically treating, and etc.) a tip portion of a pick in a manner that hardens the same, attaching a hard casing to a tip portion of a pick, coupling a hard tip member to a corner portion of a pick, curing a pick in an asymmetric manner such that different regions develop differing hardness characteristics, stamping or compressing a tip portion to increase its hardness, and the like and combinations thereof.

Figure 2:
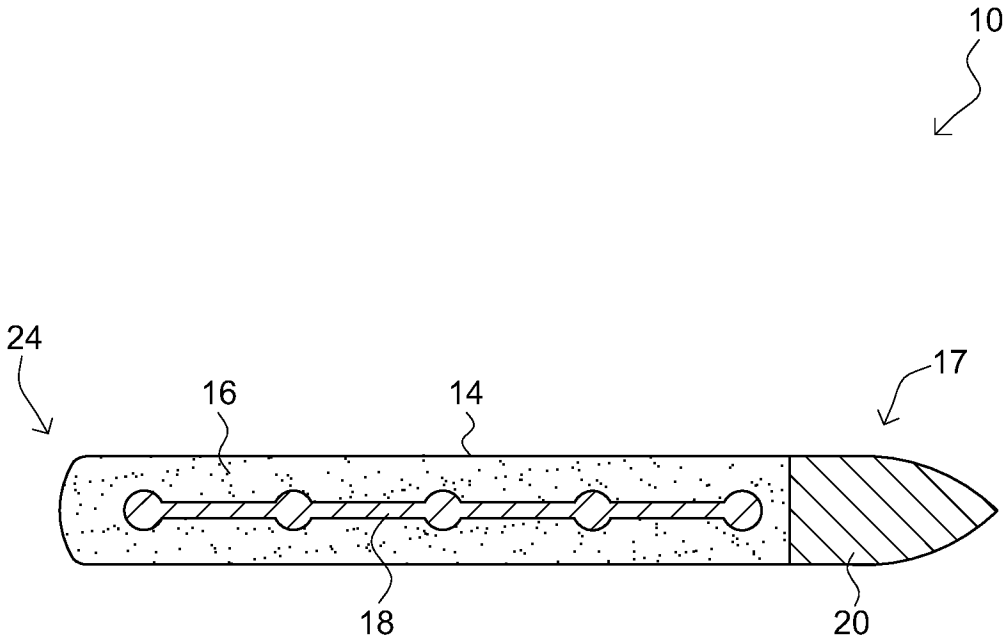
FIG. 2 is a side elevational cross-sectional view of an instrument pick, according to one embodiment of the invention.

FIG. 2 is a side elevational cross-sectional view of an instrument pick, according to one embodiment of the invention. There is shown an instrument pick 10 including a body member 14 and a hardened tip 20.

The illustrated instrument pick 10 includes a body member 14. The body member 14 includes a pliable member 18 disposed therein. The illustrated pliable member 18 is a thin wire mesh. The pliable member 18 forms a grid 24 within the body member 14. The grid 24 includes a plurality of pliable horizontal members coupled to a plurality of pliable vertical members configured to form a square grid configuration.

The body member 14 includes crushed magnetic elements 16 that are disposed throughout the body member 14. The crushed magnetic elements 16 are smaller than about 1 mm in diameter. The crushed magnetic elements 16 are aligned to induce a magnetic field orthogonal to the plane of the body member 14. The crushed magnetic elements 16 are aligned to induce a magnetic field substantially parallel to the plane of the body member.

The instrument pick 10 includes a tip member 20 that may be disposed about an end 17 of the body member 14. The tip member 20 includes a hardened region. The tip member 20 includes a hardened flat conical shell that is disposed about an end 17 of the body member 14. The tip member 20 is selectably removable. The instrument pick 10 may include a plurality of selectably removable tip members that have diverse acoustical properties. The illustrated tip member 20 is configured to not include magnetic elements.

Figure 3:
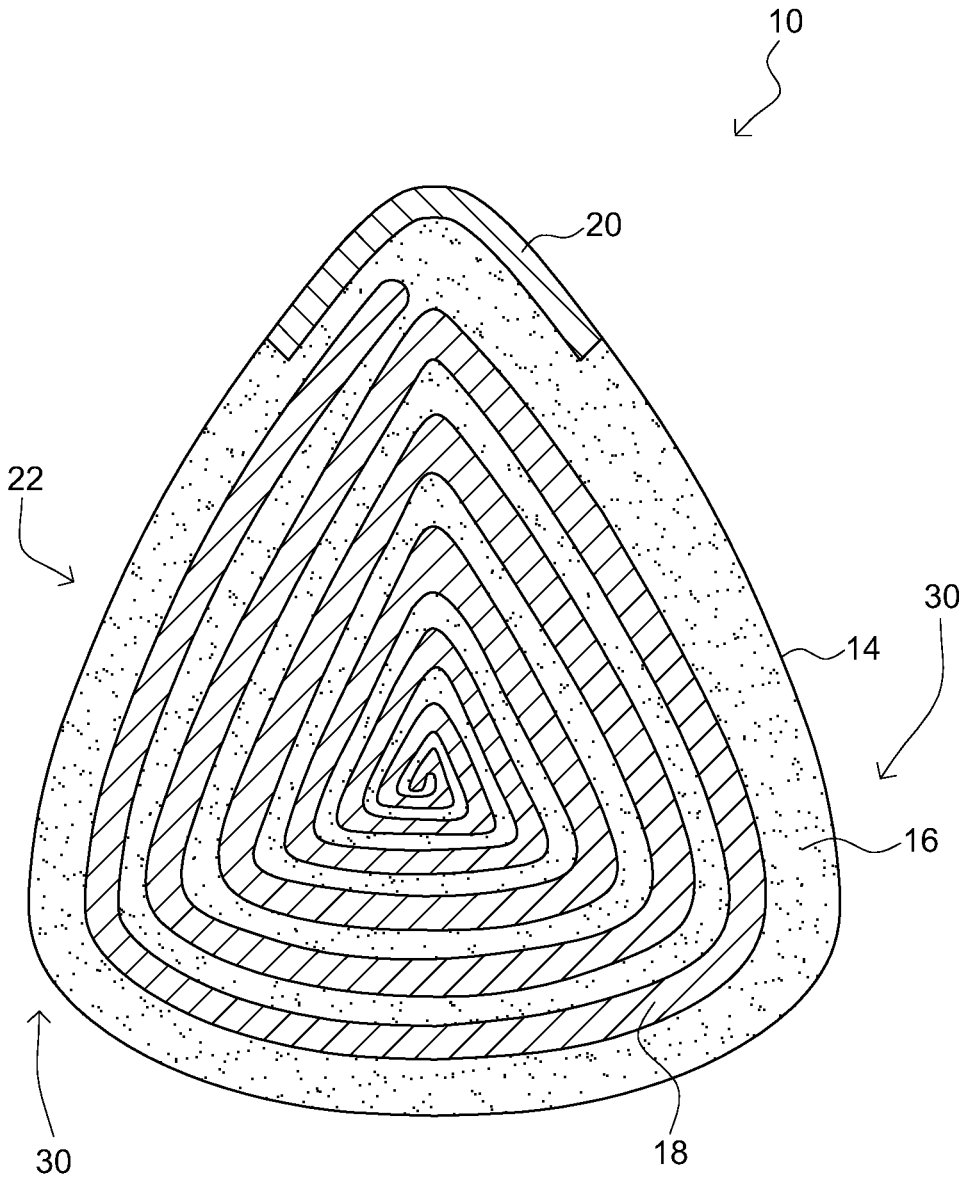
FIG. 3 is top plan cross-sectional view of an instrument pick, according to one embodiment of the invention.

FIG. 3 is top plan cross-sectional view of an instrument pick, according to one embodiment of the invention. There is shown an instrument pick 10 including a body member 14 and a hardened tip 20.

The illustrated instrument pick 10 includes a body member 14 having a pliable member 18 disposed therein. The pliable member 18 forms a grid 22 within the body member 14. The illustrated grid 22 includes a single pliable member wound spirally. The body member 14 includes a plurality of wing members 30 extending outwardly from the body member 14. The plurality of wing members 30 are configured to wrap about a finger of a user. The plurality of wing members 30 are configured to be manipulated into a size and shape conforming to a user's finger or thumb. The body member 14 includes crushed magnetic elements 16 that are disposed throughout the body member 14. The instrument pick 10 includes a tip member 20 disposed about a top end of the body member 14. The tip member 20 includes a hardened region having a hardened flat conical shell disposed about the top end of the body member 14.

In one non-limiting example, wing members extend further from a center of the pick, such that, the pick is not symmetrical as a standard pick. Such wing members may also or alternatively extend further from each other than they extend from the tip region. Accordingly, such wing members may wrap about a greater region of a thumb, guitar string, or etc. while still providing a standard tip length for use in picking and/or strumming guitar strings.

Figure 4:
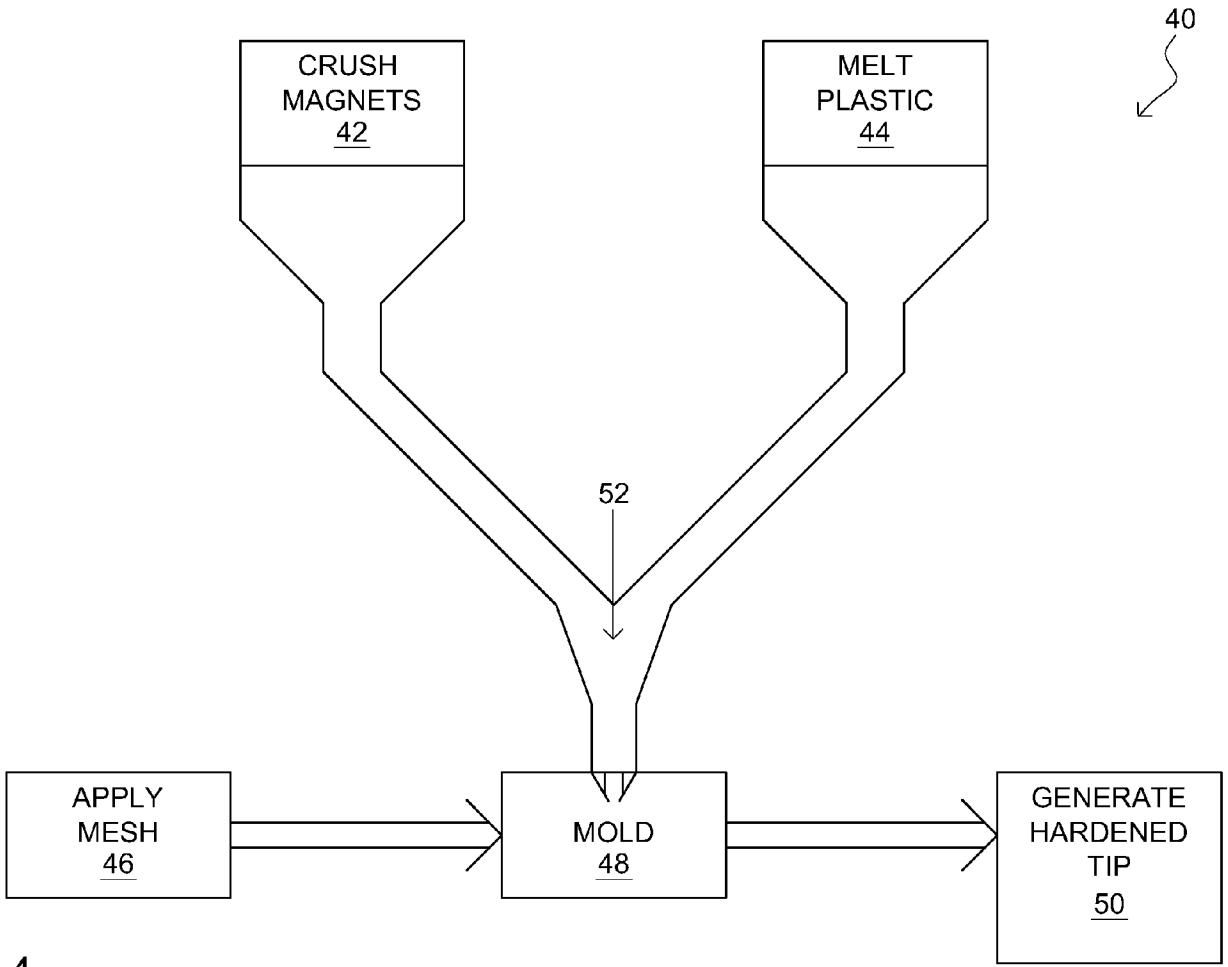
FIG. 4 is a method of manufacture of an instrument pick, according to one embodiment of the invention.

FIG. 4 is a method of manufacture of an instrument pick, according to one embodiment of the invention. There is shown a method of manufacture of an instrument pick 40.

The illustrated method of manufacturing an instrument pick 40 includes the step of crushing magnetic elements 42. The step of crushing magnetic elements 42 includes the step of crushing the magnetic elements to a size smaller than about 1 mm in diameter. The method 40 includes the step of liquefying a matrix material 44. The step of liquefying the matrix material 44 includes the step of melting a plastic polymer into a liquid. The crushed magnetic elements are combined with the liquefied matrix material in a layer 52.

The method 40 includes the step of applying a pliable member to the liquefied matrix material 46. The pliable member is configured to be in a preset form depending on the type of form desired. The pliable member may be sized and shaped according to the desired form. The step of applying a pliable member 46 includes submerging a pliable member within the liquefied matrix material. The method 40 includes the step of applying the liquefied matrix material to an instrument pick mold 48, thereby forming a pliable magnetized instrument pick. The method 40 also includes the step of providing a hardened tip to an end of the pliable magnetized instrument pick 50. The step of providing a hardened tip 50 includes chemically treating an end of the pliable magnetized instrument pick. The step of providing a hardened tip 50 includes thermally treating an end of the pliable magnetized instrument pick. The step of providing a hardened tip 50 includes asymmetrically processing the pliable magnetized instrument pick. The step of providing a hardened tip 50 includes attaching a hardened tip over an end of the pliable magnetized instrument pick.

The following are non-limiting examples of methods of hardening plastic, which are incorporated by reference herein for their supporting teachings: U.S. Pat. No. 2,670,338; U.S. Pat. No. 5,239,590; and U.S. Pat. No. 2,358,259.

The following are non-limiting examples of crushed or pulverized magnets, which are incorporated by reference herein for their supporting teachings: U.S. Pat. No. 6,638,367; U.S. Pat. No. 6,926,963; U.S. Pat. No. 3,126,617; and U.S. Pat. No. 6,709,533.

The following are non-limiting examples of magnetic paste, which are incorporated by reference herein for their supporting teachings: U.S. Patent Application No. 2007/0102663; U.S. Pat. No. 7,816,180; U.S. Pat. No. 7,514,295; and U.S. Pat. No. 6,110,569.

The following are non-limiting examples of guitar picks, which are incorporated by reference herein for their supporting teachings: U.S. Pat. No. 4,080,520; U.S. Pat. No. 3,992,975; U.S. Pat. No. 4,141,943; U.S. Pat. No. 4,543,382; U.S. Pat. No. 5,973,243; U.S. Pat. No. 6,171,107; U.S. Pat. No. 6,335,477; U.S. Pat. No. 6,791,017; U.S. Pat. No. 6,846,977; U.S. Pat. No. 6,933,430; U.S. Pat. No. 7,186,908; U.S. Pat. No. D489,396; U.S. Pat. No. 7,956,264; U.S. Patent Application No. 2004/0074370; U.S. Patent Application No. 2004/

0237753; U.S. Patent Application No. 2005/0092159; and U.S. Patent Application No. 2008/0163737.

STATEMENTS OF THE INVENTION

1. An instrument pick, comprising:

a body member including a pliable member disposed therein; wherein the pliable member forms a grid within the body member; wherein the body member further includes crushed magnetic elements disposed throughout the body member; and a tip member disposed about an end of the body member; wherein the tip member comprises a hardened region.

2. The instrument pick of claim 1, wherein the tip comprises a hardened flat conical shell disposed about an end of the body member.

3. The instrument pick of either preceding claim, wherein the crushed magnetic elements are smaller than 1 mm in diameter.

4. The instrument pick of any preceding claim, wherein the crushed magnetic elements are aligned to induce a magnetic field either orthogonal to the plane of the body member or substantially parallel to the plane of the body member.

5. The instrument pick of any preceding claim, wherein the tip member is selectably removable.

6. The instrument pick of any preceding claim, further comprising a plurality of selectably removable tip members having diverse acoustical properties.

7. The instrument pick of any preceding claim, wherein the body member includes a plurality of wing members extending outwardly from the body member and configured to wrap about a finger of a user.

8. The instrument pick of any preceding claim, wherein the grid includes a plurality of pliable horizontal members coupled to a plurality of pliable vertical members configured to form a square grid configuration.

What is claimed is:

1. An instrument pick, comprising:

a flexible body member including:

a pliable member disposed within the body member, the pliable member forming a grid within the body member; and crushed magnetic elements disposed throughout the body member; and a tip member disposed about an end of the body member; wherein the tip member comprises a hardened region of a hardness substantially greater than that of the body member.

2. The instrument pick of claim 1, wherein the tip comprises a hardened flat conical shell disposed about an end of the body member.

3. The instrument pick of claim 1, wherein the crushed magnetic elements are smaller than about 1 mm in diameter.

4. The instrument pick of claim 1, wherein the crushed magnetic elements are aligned to induce a magnetic field orthogonal to the plane of the body member.

5. The instrument pick of claim 1, wherein the crushed magnetic elements are aligned to induce a magnetic field substantially parallel to the plane of the body member.

6. The instrument pick of claim 1, wherein the tip member is selectably removable.

7. The instrument pick of claim 1, further comprises a plurality of selectably removable tip members having diverse acoustical properties.

8. The instrument pick of claim 1, wherein the body member includes a plurality of wing members extending outwardly from the body member and configured to wrap about a finger of a user.

9. The instrument pick of claim 1, wherein the grid includes a plurality of pliable horizontal members coupled to a plurality of pliable vertical members configured to form a square grid configuration.

10. The instrument pick of claim 1, wherein the grid includes a single pliable member wound spirally.

11. The instrument pick of claim 1, wherein the pliable member is a thin wire mesh.

12. The instrument pick of claim 1, wherein the tip member does not include magnetic elements.

13. The method of manufacturing an instrument pick, comprising the steps of:

a) crushing magnets;

b) liquefying a matrix material;

c) applying the crushed magnets to the liquefied matrix material;

d) applying a pliable member to the liquefied matrix material;

e) applying the liquefied matrix material to an instrument pick mold, thereby forming a pliable magnetized instrument pick;

f) providing a hardened tip to an end of the pliable magnetized instrument pick.

14. The method of claim 13, wherein the crushed magnets are applied to the liquefied matrix material in a layer.

15. The method of claim 14, wherein the step of liquefying the matrix material includes melting a polymer.

16. The method of claim 15, wherein the step of applying a pliable member includes submerging a pliable member within the liquefied matrix material.

17. The method of claim 16, wherein the step of providing a hardened tip includes chemically treating an end of the pliable magnetized instrument pick.

18. The method of claim 17, wherein the step of providing a hardened tip includes thermally treating an end of the pliable magnetized instrument pick.

19. The method of claim 18, wherein the step of providing a hardened tip includes asymmetrically processing the pliable magnetized instrument pick.

20. The method of claim 19, wherein the step of providing a hardened tip includes attaching a hardened tip over an end of the pliable magnetized instrument pick.

* * * * *